US005762171A

United States Patent [19]

Mizer

[11] Patent Number: 5,762,171

[45] Date of Patent: Jun. 9, 1998

[54] LINT CLEANING APPARATUS

[75] Inventor: Michael A. Mizer, Savannah, Ga.

[73] Assignee: Carver, Inc., Savannah, Ga.

[21] Appl. No.: 713,161

[22] Filed: Sep. 12, 1996

[51] Int. Cl.[6] ..... D01B 1/04

[52] U.S. Cl. ..... 19/41

[58] Field of Search ..... 19/39, 40, 41, 19/42, 44, 48 R, 64.5, 46, 47; 426/484; 99/603, 604

[56] References Cited

U.S. PATENT DOCUMENTS

| | | | |
|---|---|---|---|
| 437,084 | 9/1890 | Bohn | 19/41 |
| 440,259 | 11/1890 | Burnet et al. | 19/41 |
| 546,275 | 9/1895 | Faulker | 19/41 |
| 732,869 | 7/1903 | Larson . | |
| 884,671 | 4/1908 | Lamb . | |
| 2,310,598 | 2/1943 | Ricker | 19/41 |
| 4,102,017 | 7/1978 | Foerster | 19/203 |
| 4,699,049 | 10/1987 | Mizer | 99/568 |
| 4,942,643 | 7/1990 | Kincer et al. | 19/41 |
| 4,967,448 | 11/1990 | Mizer | 19/40 |

OTHER PUBLICATIONS

Carver, Inc. Brochure: 3–High Lint Cleaner, date unknown.

*Primary Examiner*—C. D. Crowder
*Assistant Examiner*—Larry D. Worrell, Jr.
*Attorney, Agent, or Firm*—Akin, Gump, Strauss, Hauer & Feld, L.L.P.

[57] ABSTRACT

A multistage lint cleaning apparatus includes plural series arranged rotary drum beaters in a first cleaning stage, each beater having a separating screen disposed adjacent thereto for separating particulate material and fine lint from longer fiber lint. Each screen is configured as a drawer supported within an enclosure for insertion and removal, at will. Clean lint discharged from the first cleaning stage passes through an air gap and into a duct connected to an aspirating nozzle for further separation of particulate material. A linear belt conveyor receives particulate material and fine lint from the first cleaning stage for discharge to a second cleaning stage also comprising a series of rotary drum beaters. Separating screens associated with each beater of the second cleaning stage are also configured to be inserted in and removed from an enclosure, at will. A third cleaning stage comprises a vibrating screen. Lint discharged from the second and third stages is inducted by an pneumatic conveying system, including an aspirating or induction nozzle. Spaced apart tubular air jet manifolds are disposed below the screens of at least the first cleaning stage and are supported on the apparatus frame for movement between working and non-working positions of respective rows of jet nozzle ports in the manifolds by pneumatic actuators whereby the manifolds may be moved to a position to prevent clogging of the nozzle ports by particulate material falling through the screens.

34 Claims, 7 Drawing Sheets

LINT CLEANING APPARATUS

FIELD OF THE INVENTION

The present invention pertains to a multistage cleaning apparatus, including plural rotary beater stages, a vibratory separator stage, and a linear conveyor between beater stages for cleaning cotton lint to remove seed hulls, field trash and other contaminants which are carried over with the lint from a cottonseed delinting operation, for example.

BACKGROUND

In the processing of cottonseed, it is desirable to remove as much lint as possible from the seed hull in order to improve the seed processing operation and the yield of quality cottonseed oil. For many years, it has been recognized that the fine cotton lint removed from cottonseed in delinting equipment has commercial value. Clean cotton lint is essentially 100% cellulose and has well established commercial applications, such as use as a binder in manufactured paper, as hygienic cotton for medical and personal use, in the manufacture of munitions and essentially any commercial application which requires a cellulose based material. However, essentially all of the above-mentioned commercial applications of fine cotton lint requires a clean lint product.

The production of high quality, substantially clean cotton lint has experienced longstanding problems. Removal of all foreign matter, such as seed hulls, plant particles, field dirt and similar trash or "pepper" from the fine gauzy lint is difficult since the lint is of such low mass and many of the aforementioned fine particulates are also of such low mass as to make separation from the lint a vexatious problem. Lint cleaning apparatus have been developed which require multiple stages of cleaning with a rotary drum type beating operation, typically used as the first stage, followed by conveying the partially cleaned lint to second and third stages using auger-type conveyors. The second and third stage cleaning mechanisms have also been characterized somewhat as auger flight type structures with spiral shaped members which include small paddles or beater portions formed on the peripheral edge of the auger flight.

It has been determined, in pursuing the development of lint cleaning apparatus to provide ever greater purities in a range of 75% to 80% clean lint, that the auger or stationary basket-type cleaning stages, as well as the auger conveyors used in transporting the lint between stages, tend to compact the lint to defy or reduce the ability to rid the lint of seed hulls, motes, and other particulate contaminants trapped in the gauzy lint material. Accordingly, further improvements have been sought in lint cleaning apparatus which will minimize compacting of the lint during the cleaning process, provide a final cleaned lint product having a greater purity than heretofore obtainable with prior art apparatus, provide for cleaning lint from different cotton-producing regions, climates or from cotton picked under different weather conditions and using various types of equipment, be capable of cleaning cotton lint of different varieties, be capable of being easily cleaned itself and provide a combination of cleaning stages which meet all of the desiderata stated above. It is to these ends that the present invention has been developed.

SUMMARY OF THE INVENTION

The present invention provides an improved lint cleaning apparatus, particularly adapted for cleaning cotton lint which has been produced in a cottonseed delinting operation.

In accordance with one aspect of the present invention a multi-stage lint cleaning apparatus is provided which minimizes compacting of lint being processed by the apparatus, produces lint having a higher degree of cleanliness than is provided by prior art apparatus and accomplishes the cleaning operation in substantially three cleaning stages. In particular, the first cleaning stage comprises a multiple rotary drum beater stage, the second cleaning stage also comprises a multiple rotary drum beater stage and the third stage comprises a vibrating screen or so-called shale shaker stage. Clean lint is drawn off after each stage by a pneumatic conveying flue system and lint cleaned in the second and third stages is recycled back through the apparatus.

In accordance with another aspect of the present invention a multiple rotary drum beater type lint-cleaning apparatus is provided wherein separator screens associated with each drum-type beater may be easily removed for heavy cleaning or replaced with screens having different porosity or sieve size to accommodate different lint characteristics, expected types of contaminants or the like. In particular, each rotary drum beater is provided with a screen which is mounted on a removable drawer disposed in the beater cabinet whereby each drawer may be easily inserted in a working position of the screen or removed from the cabinet for cleaning or replacement of the screen.

In accordance with another aspect of the present invention a multi-stage lint cleaning apparatus is provided wherein lint and contaminant materials passing from a first stage to a second stage are conveyed by a linear, generally planar conveyor, such as endless belt-type conveyor to minimize compacting of the lint and to allow the lint to reside, generally widely dispersed and fluffed so that further separation of seed hulls, shale and other contaminants may be carried out in the second stage.

In accordance with a further aspect of the present invention a lint cleaning apparatus is provided wherein separating screens which are adapted to separate clean lint from contaminants and fine lint entrained with the contaminants are easily cleaned in situ and at will by an arrangement of multiple air jet discharge manifolds which are disposed in proximity to the lint separator screens for cleaning the screens to remove clogged screen ports or openings. The manifolds are preferably characterized as elongated tubular members which are supported for rotation between a working position and a position which orients air jet nozzles in the manifolds in such a way as to substantially minimize clogging the nozzles with lint or trash material flowing through the screens and impinging on the manifolds.

The present invention still further provides an improved arrangement of multiple lint cleaning stages, including a vibrating screen or shale shaker type final cleaning stage, to prevent compacting of the lint as it is being cleaned as well as while being transported between stages. The lint cleaning apparatus advantageously utilizes two multiple rotary drum beater cleaning stages which are operated to rotate drum-type beaters in such a way as to optimize the cleaning and separating effect of the beaters as the lint is moved progressively from one rotary drum beater to the next in each stage.

Those skilled in the art will further appreciate the above-mentioned advantages and features of the invention together with other important aspects thereof upon reading the detailed description which follows in conjunction with the drawing.

DESCRIPTION OF A PREFERRED EMBODIMENT

Figure 1:
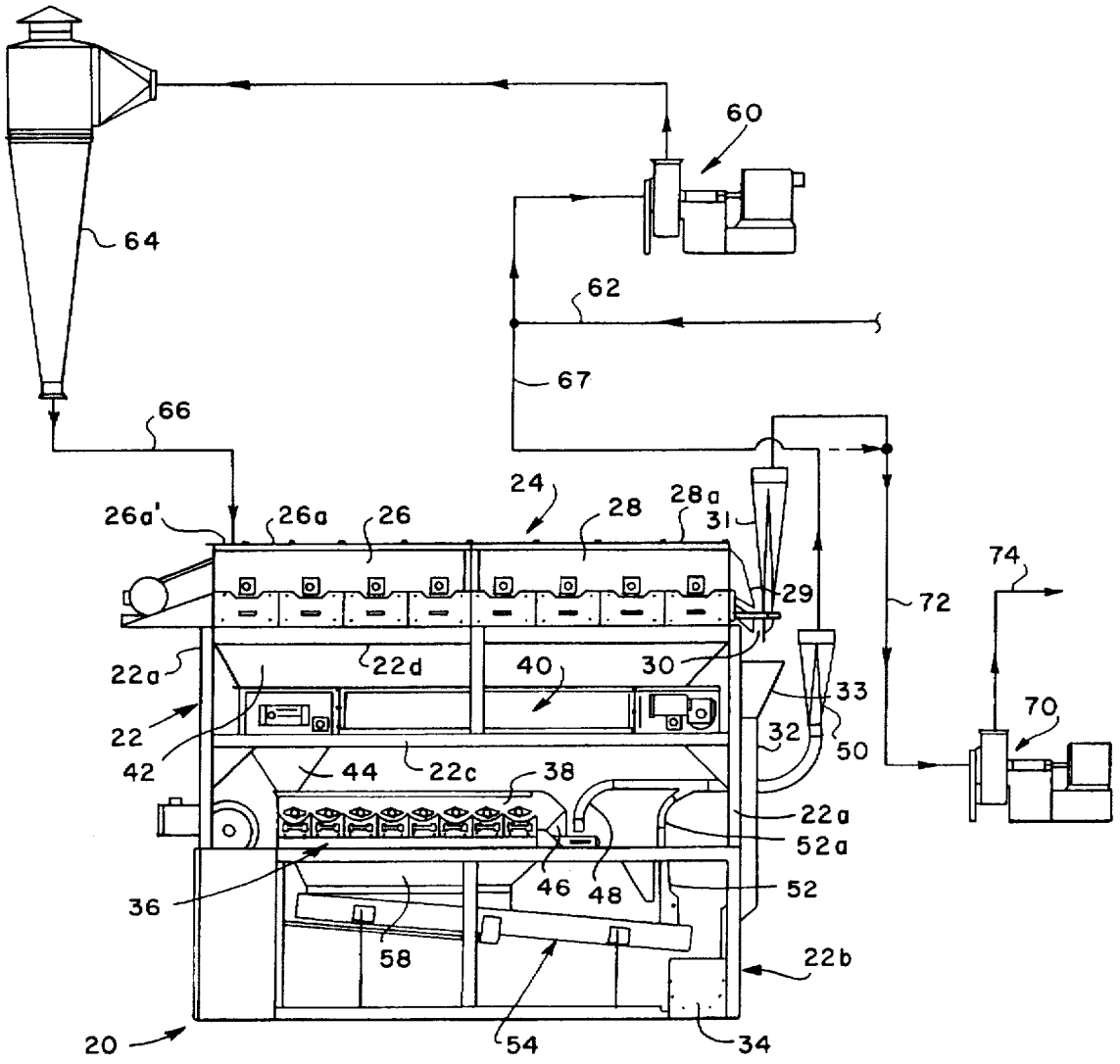
FIG. 1 is a combination schematic diagram and side elevation of an improved lint cleaning apparatus in accordance with the present invention.

In the description which follows like parts are marked throughout the specification and drawing with the same reference numerals, respectively. The drawing figures are not necessarily to scale and certain features may be shown in generalized or somewhat schematic form in the interest of clarity and conciseness.

Referring to FIG. 1 there is illustrated an improved lint cleaning apparatus in accordance with the invention and generally designated by the numeral 20. The lint cleaning apparatus 20 comprises a frame 22, generally characterized by four spaced apart upstanding corner post members 22*a*, two shown in FIG. 1, supported on a subframe 22*b* which is a generally rectangular skeletal box. Longitudinal frame members 22*c* and 22*d* interconnect the post members 22*a* to form a second generally rectangular skeletal boxlike frame disposed on top of subframe 22*b*. The apparatus 20 is advantageously characterized by a first lint cleaning stage, generally designated by numeral 24, which comprises a plurality of series arranged rotary drum beaters to be described in further detail herein. The aforedescribed beaters are disposed in adjacent, generally rectangular box-like cabinets or enclosures 26 and 28. The enclosures 26 and 28 include removable top cover members 26*a* and 28*a*, respectively, and cover 26*a* includes a dirty lint inlet port 26*a*'. Enclosure 28 has a clean lint discharge port formed by a duct 29 which discharges lint into an air gap 30 adjacent the inlet of an aspirating nozzle 31 suitably mounted on and adjacent enclosure 28 for entraining clean lint. A trash discharge duct 32 is disposed below the air gap 30 and includes an inlet hopper portion 33 for receiving particulate material trash which is separated from clean lint being discharged from the first stage outlet duct 29 as it is inducted into nozzle 31. Trash separated from clean lint in the air gap 30 flows to a suitable receptacle 34 mounted on the subframe 22*b*.

The apparatus 20 includes a second lint cleaning stage, generally designated by numeral 36, and comprising a generally boxlike cabinet or enclosure 38 in which a plurality of side-by-side rotary drum beater devices are mounted and are similar in construction to the aforementioned beater devices in cleaning stage 24. Relatively fine lint and particulate material which is not carried over to discharge duct 29 is conveyed to cleaning stage 36 by a linear, generally planar endless belt-type conveyor 40 having an inlet comprising an elongated depending duct 42 disposed below the cleaning stage 24 and a discharge duct 44 which is in communication with the interior of the enclosure 38 for conveying lint and particulate material to the second cleaning stage 36. Lint cleaned by cleaning stage 36 is discharged from enclosure 38 through a discharge duct 46 and is inducted into a pneumatic aspirating nozzle 48 in communication with a common air conduit transition part 50. A second aspirating nozzle 52 is connected to an inlet plenum 52*a* and to air conduit transition part 50. Plenum 52*a* is disposed for entraining clean lint at the discharge end of a third lint cleaner stage comprising a vibrating screen separator and conveyor assembly 54. Particulate material and lint which is not carried over to discharge duct 46 from cleaning stage 36 descends through a discharge duct 58 to the vibrating screen separator and conveyor 54 for a final separation of particulate material from lint.

Referring further to FIG. 1, the lint cleaning apparatus 20 is in circuit with a system comprising a motor driven centrifugal fan or blower, 60 which is operable to convey lint contaminated with particulate material, such as seed hulls, plant particles, field dirt and similar particulate materials which typically are found in cotton lint taken from a seed delinting operation. This contaminated lint is conveyed to the motor driven blower or fan 60 by way of a suitable conduit 62 from a source, not shown, and is conveyed through the blower in a conventional manner to a cyclone separator 64 wherein the conveying air is separated from the lint and lint is then conveyed primarily by gravity and some conveying air by way of a conduit 66 to the inlet port 26*a*' of rotary drum beater stage 24. A second motor driven centrifugal blower or vacuum pump 70 is connected to a conduit 72 which is connected to air aspirating nozzle 31 for entraining lint cleaned by the cleaning stage 24 for discharge through the pump 70 to a clean lint discharge conduit 74. As shown in FIG. 1, the air conduit transition part 50 is adapted to be connected to either the conduit 72 or to the conduit 62 for recirculating lint entrained by the transition part 50 from the air aspirating nozzles 48 and 52. Blower or fan 60 may have sufficient capacity to cause sufficient flow of air through inlet aspirating nozzles 48 and 52 and air transition part 50 even if the transition part 50 is connected to conduit 62 by way of a connecting conduit 67, as shown. Alternatively, nozzle 31 and air transition part 50 may be characterized as air-lint eductor nozzles energized by a source of motive air in a conventional manner. In all events, positive flow of clean lint may be obtained with the system shown in either arrangement of the discharge flow path for material leaving aspirating nozzle 31 and air transition part 50.

Figure 2:
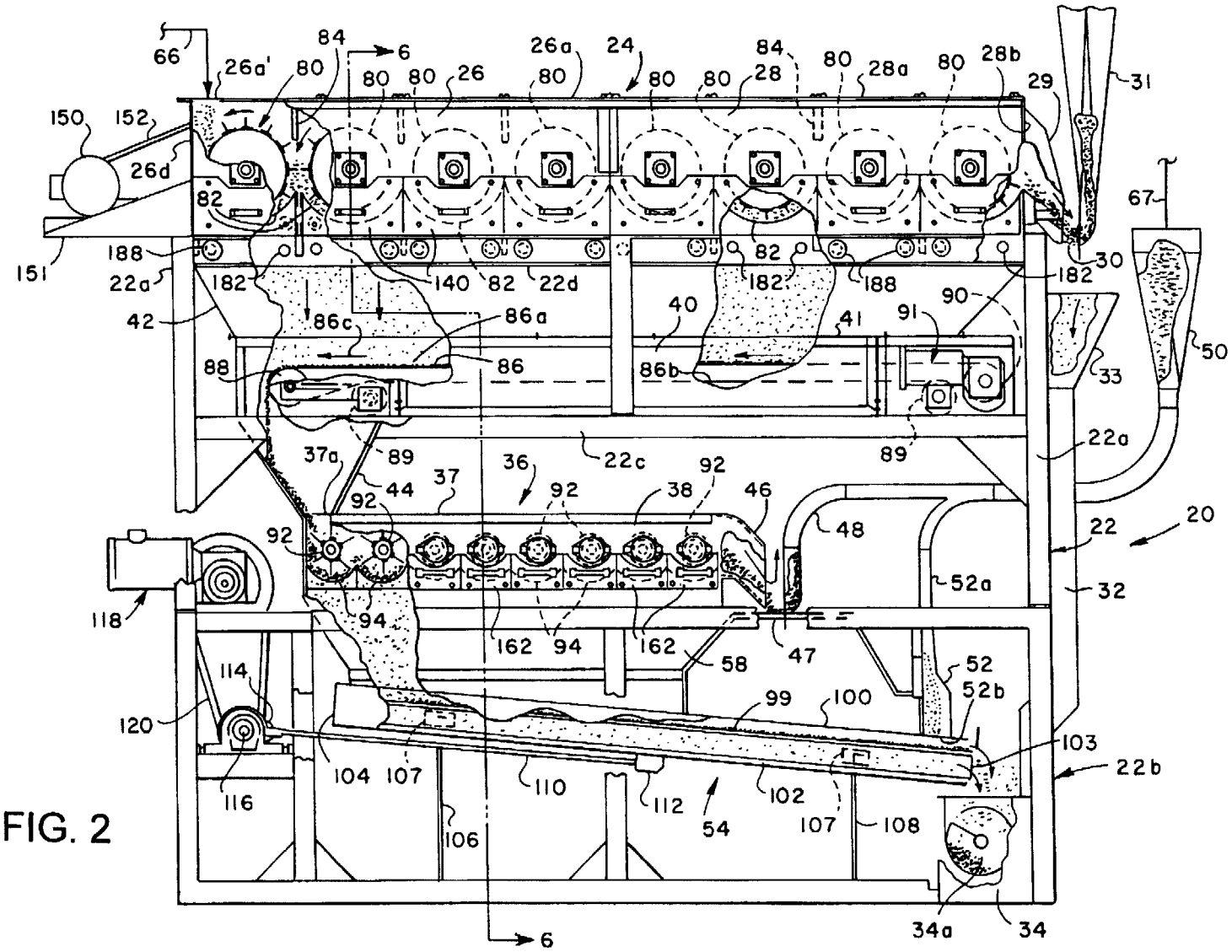
FIG. 2 is a side elevation of the apparatus shown in FIG. 1 on a larger scale and with portions of the apparatus broken away to show certain important features.
Figure 4:
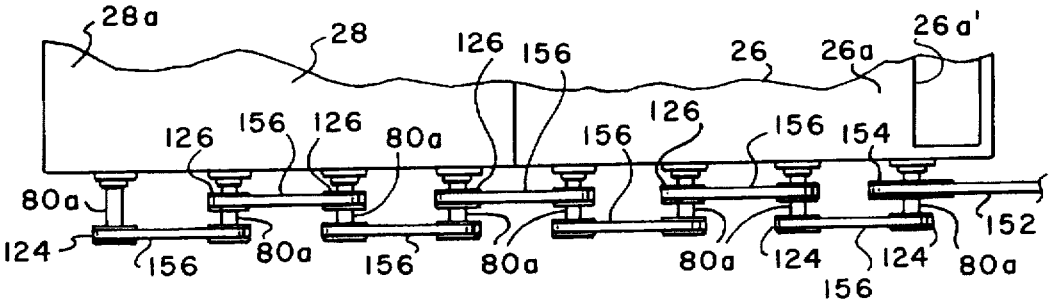
FIG. 4 is a view of the apparatus shown in FIGS. 1 through 3.
Figure 3:
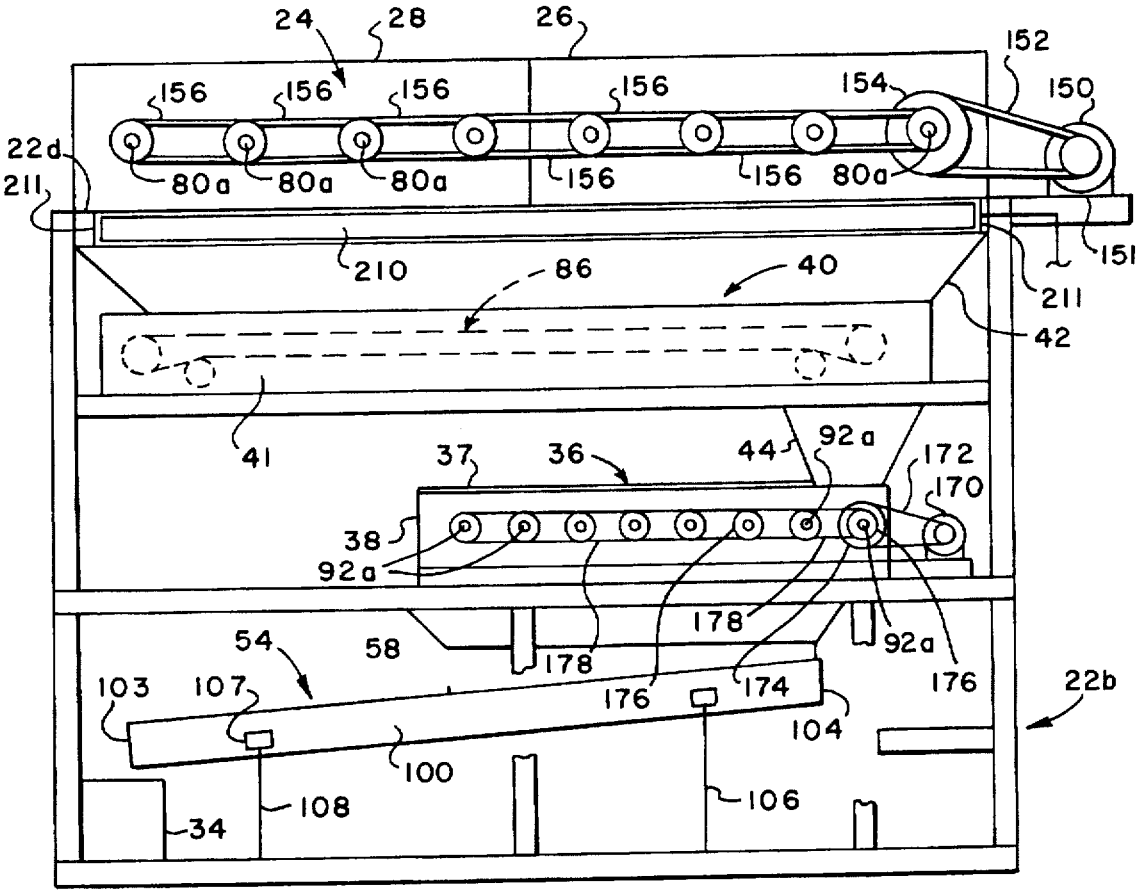
FIG. 3 is an opposite side elevation of the apparatus.
Figure 6:
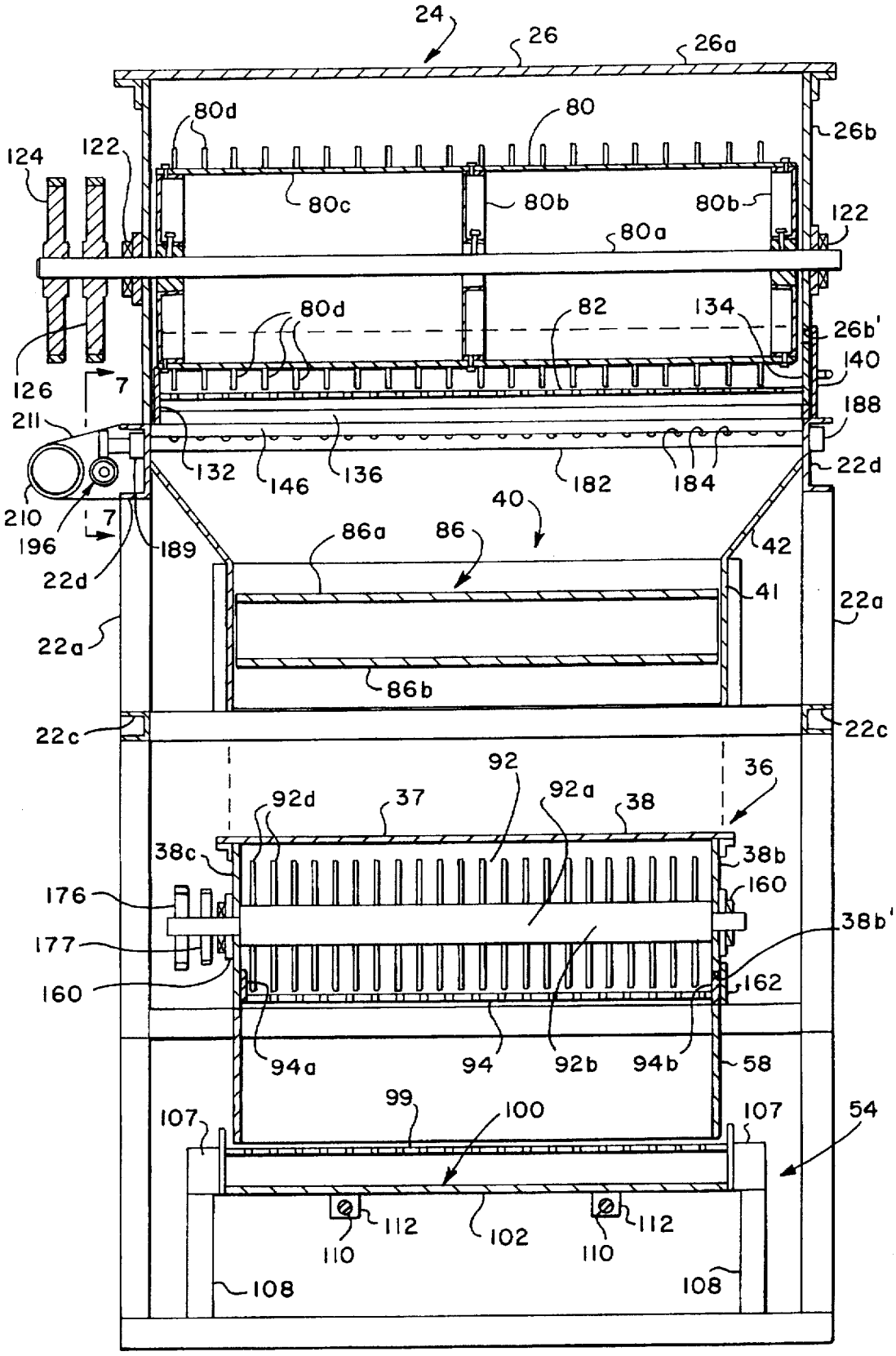
FIG. 6 is a section view taken generally along the line 6—6 of FIG. 2.

Referring now to FIGS. 2, 3 and 4, and FIG. 2 in particular, the apparatus 20 is shown in further detail wherein, for example, the first lint cleaning stage 24, as illustrated, comprises eight, side by side, rotatable drum beaters 80 which are mounted for rotation in a counterclockwise direction, viewing FIG. 2, within the enclosures 26 and 28, respectively, as shown. The beaters 80 are mounted adjacent respective, generally arcuate, separator screens 82 supported adjacent to and below each of the rotary beaters 80. Plural spaced apart partitions 84 depend within the enclosures 26 and 28 from the covers 26*a* and 28 *a*, respectively, between each of the beaters 80 for controlling the flow of lint through the cleaning stage 24. Particulate laden lint enters the enclosure 26 through the port 26*a*' and is beaten or agitated severely while being conveyed by the rotating beaters 80 from one to the other serially toward the discharge duct 29 attached to an endwall 28*b* of enclosure 28. As shown in FIGS. 2 and 6, enclosure 26 includes opposed sidewalls 26*b* and 26*c* and an endwall 26*d*, FIG. 2. Enclosure 28 is similarly constructed and the ends of enclosures 26 and 28 which abut each other are open. Of course, the bottom side of each of the enclosures 26, 28 and 38 is open also. Substantially dirt free lint is discharged from the duct 29 through the air gap 30 and is inducted into the aspirating nozzle 31 for final discharge from the apparatus 20 by way of the vacuum pump-blower 70 and discharge conduit 74.

Lint and particulate material which passes through the respective screens 82 is discharged via the duct 42 onto the surface of an endless belt 86, FIGS. 2 and 6, disposed within a generally rectangular boxlike enclosure 41 of the conveyor 40. Belt 86 includes an upper generally planar material conveying run 86*a* and is trained over respective rollers 88 and 90 at opposite ends of enclosure 41 for the conveyor 40. Adjustable guide or idler rollers 89 are also supported by the enclosure 41 adjacent the respective conveyor rollers 88 and 90, as shown, for tensioning the belt along its return run 86*b*. Conveyor roller 90 is suitably rotatably driven by a motor and gear reduction drive unit 91, FIG. 2, which is drivably connected to the roller 90 for traversing the endless belt 86 in the direction of arrow 86*c* as shown in the cut away portion of the duct 42 and the enclosure 41 in FIG. 2.

Accordingly, short fiber lint and particulate material which has been separated in the beater type cleaning stage 24 falls onto the conveyor belt 86 and is traversed in the direction of arrow 86*c* to discharge duct 44 whereupon this material drops into enclosure 38 of cleaning stage 36 by way of an inlet port 37*a*, formed in a removable top cover 37 of the enclosure 38. The enclosure 38 supports a plurality of spaced apart rotatable drum-type beater members 92 arranged in a side-by-side series flow arrangement for the lint and particulate material entering the enclosure 38 through the port 37*a*. The beaters 92 are supported for rotation in the same counterclockwise direction, viewing FIG. 2, by the enclosure 38 and are drivenly connected to drive means to be described in further detail herein. Each beater 92 also includes an arcuate separator screen 94 disposed under and adjacent thereto and similar to the screens 82. Screens 94 are disposed for separating lint and particulate material from lint which is beat or agitated and carried over from each beater 92 to the next so that substantially clean lint progresses from inlet port 37*a* to discharge duct 46 for transfer to air aspirating nozzle 48 by entraining air flowing into the nozzle at an air gap 47, FIG. 2.

Lint and particulate material which falls through the separator screens 94 is guided by the duct 58 onto a generally planar perforated screen 99 of the vibrating screen separator stage 54. Particulate material separated from clean lint in the air gap 47 also falls onto the perforated screen 99. The screen 99 is supported on a generally rectangular open top, shallow pan 100 having a generally planar bottom plate 102 spaced below the screen. The pan 100 is canted at a moderate angle from the horizon so that a discharge end 103 of the pan is disposed lower than an upper or inlet end 104. The discharge end 103 of the pan 100 is devoid of an endwall to allow particulate material to descend along the plate 102 and fall into the receptacle 34. A suitable auger conveyor 34*a* is disposed in receptacle 34 for conveying particulate material away from the apparatus 20 for disposal. As previously discussed, lint deposited on the screen, 99 moves progressively along the screen toward the discharge end 103 of the pan 100 until it is directly under inlet port 52*b* of plenum 52*a* whereupon air inducted through the port into the air transition part 50 will entrain clean lint from screen 99 into and through the aspirating nozzle 52 to the air transition part 50 for further conveyance as described above and shown in FIG. 1.

The vibrating screen cleaning or separator stage 54 is further characterized by flexible support structure for the pan 100 and its associated screen 99 and bottom plate 102. In particular, as shown in FIGS. 2 and 6, the pan 100 is supported by four upstanding leaf spring members 106 and 108 which are spaced apart from each other on opposite sides of the pan 100 and suitably thereto by brackets 107, respectively. Elongated reciprocating rods 110, one shown in FIG. 2, are each connected to the pan 100 by a suitable connector 112 at one end thereof. The opposite ends of the respective rods 110 are connected to crank throws 114, one shown, of an eccentric drive comprising a crankshaft 116 supported for rotation on frame 22 *b* and drivenly connected to a drive motor 118 through suitable drive means including an endless belt 120. Accordingly, rotation of the crankshaft 116 causes relatively rapid reciprocation of the rods 110 and the pan 100 to vibrate the screen 99 to effect separation of particulate material from lint deposited on the screen and to progressively move the lint toward the inlet port 52*b* of the air aspirating nozzle 52.

Those skilled in the art will appreciate from the foregoing description of the progression of lint and particulate material through the apparatus 20, that the rotary drum beaters 80 and 92 effectively separate particulate material from lint progressing through the respective cleaning and separating stages 24 and 36. Lint which falls through the separator screens 82 and 94 is also maintained in a noncompacted condition thanks to the arrangement of the endless belt conveyor 40 and the vibrating screen or shale shaker type separating and cleaning stage 54, respectively. In this way cleaned lint which is recovered by the transition duct or part 50, in particular, has not been compacted as a result of the cleaning operation.

Referring further to FIGS. 2, 3, 4 and 6, each of the rotary drum beaters 80 is characterized by a shaft 80*a*, see FIG. 6, supported for rotation on spaced apart bearings 122 which are, respectively, supported on sidewalls 26*b* and 26*c* of the enclosure 26, for example. The beaters 80 disposed in enclosure 28 are supported in a similar manner to that described and shown in FIG. 6. One end of shaft 80*a* is provided with spaced apart drive pulleys 124 and 126 supported on the shaft 80*a* for rotation therewith. Spaced apart cylindrical hub members 80*b* are supported on the shaft 80*a* and support a cylindrical cover part 80*c* of beater 80 and on which circumferentially spaced apart rows of radially outward projecting beater pins 80*d* are mounted, as shown in FIG. 6. Further clarification of the arrangement of the beater pins 80*d* may be obtained from viewing FIG. 7 also.

Figure 7:
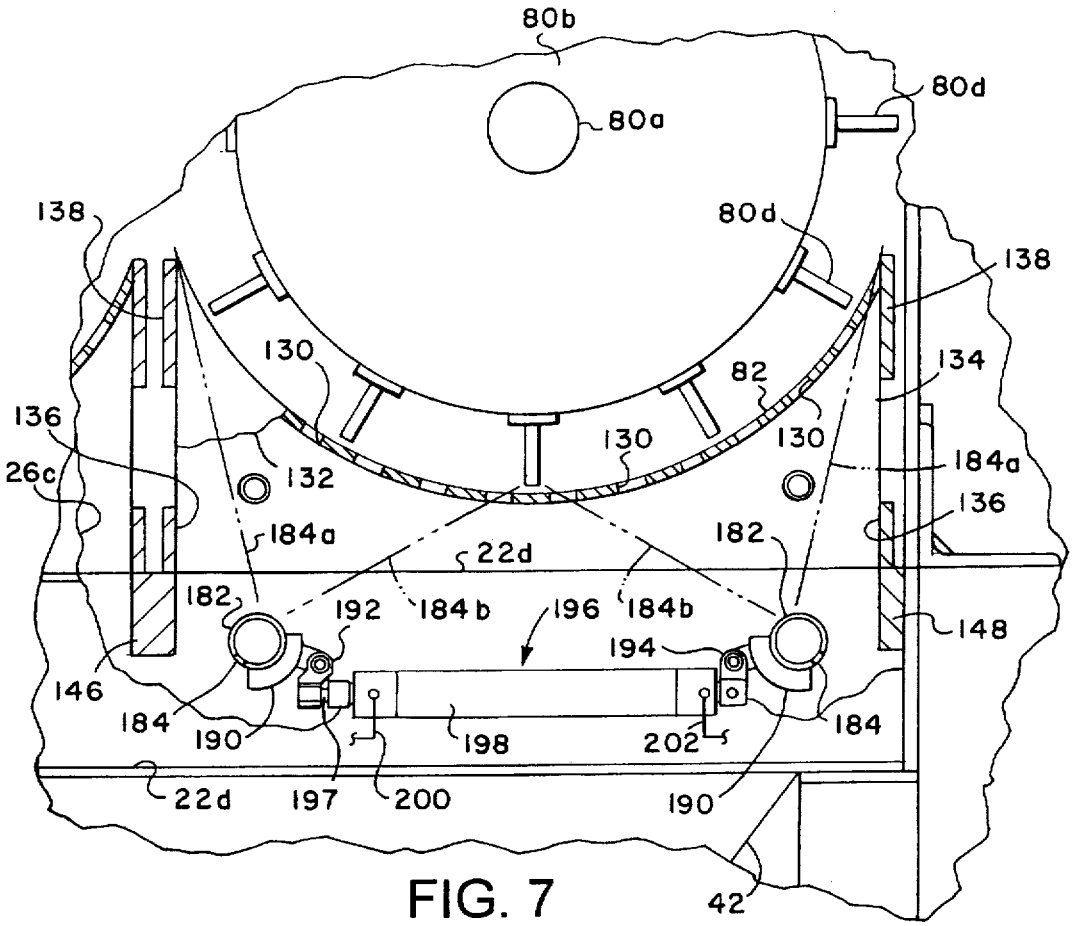
FIG. 7 is a detail view taken generally from the line 7—7 of FIG. 6 with certain structural components at least partially broken away to show the separating screen cleaning mechanism.
Figure 5:
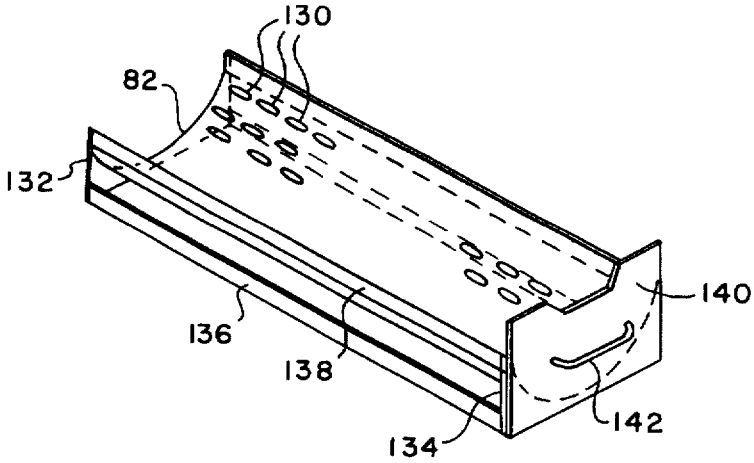
FIG. 5 is a perspective view of one of the removable drawer type separator screens.

The sidewall 26*b* of enclosure 26 includes suitable spaced apart openings 26*b*', one shown in FIG. 6, through which each screen 82 may be inserted in the enclosure and removed therefrom, at will. Enclosure 28 is also provided with such openings for insertion and removal of screens 82 with respect thereto. Referring briefly to FIG. 5, one of the screens 82 is shown in further detail as being characterized by a partial arcuate plate having longitudinally extending and circumferentially spaced rows of slots 130 formed therein of a suitable pattern and opening size to provide for separation of particulate material and short lint fibers from lint passing through the separator or cleaning stage 24. Each screen 82 includes opposed transverse end plate members 132 and 134 and longitudinal reinforcing members 136 and 138 extending therebetween as shown. A drawer plate member 140 may be removably connected to screen support plate 134 by conventional mechanical fasteners, not shown, and is provided with a suitable handle means 142 thereon. Each screen 82 may be inserted in enclosure 26 or 28 to a working position, such as through a suitable opening **26*b*' in sidewall 26*b*, for example, to the position shown in FIG. 6. Each screen 82 may be selectively removed from its working position by merely sliding the screen out of the enclosure 26 or 28, when desired. In this way each of the screens 82 may be removed and replaced by a screen having a different size of its respective slots 130 to accommodate different lint sources, types of lint and so forth to provide more effective cleaning and separation of particulate material therefrom. Accordingly, by merely inserting or removing the drawer-like screen or screens 82, with respect to the enclosure 26 or 28 each screen may be interchanged, at will. As shown in FIG. 7, the screens 82 are suitably supported by transverse narrow cross section beam members 146 and 148, two shown in FIG. 7, which are spaced apart from each other and extend between the frame members 22*d*** below the respective screens.

Referring now to FIGS. 3 and 4, the rotary drum beaters 80 are each rotatably driven by a drive train including a suitable drive motor 150 supported on a bracket 151 secured to enclosure 26. Motor 150 is drivably connected to the first beater 80 adjacent the port **26*a* ' through an endless belt 152 trained over a drive pulley 154 mounted on shaft 80*a* of the first beater. The shaft 80*a* of the first beater 80 which is disposed adjacent to the port 26*a*' also supports a drive pulley 124 which is drivably connected to a drive pulley 124 of the second beater 80 by an endless drive belt 156. The shaft 80*a* of the second beater 80 also supports a drive pulley 126 which is drivably connected to a second drive belt 156. Each successive stage of the eight stages of beaters 80, except the last stage, support drive pulleys 124 and 126 on their respective shafts 80*a* and which are connected to each other through respective sets of drive belts 156, as shown in FIG. 4, so that all of the beaters 80 are driven in the same direction at substantially the same rotative speed and may be driven in timed relationship to each other. For example, the pulleys 124 and 126 may have suitable cogs formed thereon and the belts 156 may also be cog belts or otherwise adapted for driving the beaters 80 in timed relationship to each other, if desired. Other conventional drive means such as endless chains, gear trains or the like may be used in place of the drive belt arrangement shown in FIGS. 3 and 4. The pulleys 124 and 126 may also be replaced by pulleys of larger or smaller effective diameter so that the speeds of the respective beaters 80** may be varied, if desired.

Referring again to FIG. 6, one of the beaters 92 is illustrated supported between opposed side plates **38*b* and 38*c* of the enclosure 38. Each beater 92 includes a shaft 92*a* mounted for rotation on spaced apart bearings 160 suitably supported on the side walls 38*b* and 38*c* of the enclosure 38. Each beater 92 also includes circumferentially spaced apart axially extending rows of beater pins 92*d* which are supported on and project radially outwardly from a hub portion 92*b* of shaft 92*a***.

Sidewall **38*b* also includes spaced apart openings 38*b*', one shown, formed therein for insertion of and removal of the separator screens 94 from the lint cleaning stage 36 in the same manner that the screens 82 may be inserted in and removed from the enclosures 26 or 28 of the cleaning stage 24. Each arcuate screen 94 may, for example, have opposed transverse end plate members 94*a* and 94*b*, FIG. 6, and wherein end plate 94*b* is secured to a planar drawer plate member 162 shown contiguous with sidewall 38*b* in the working position of screen 94 in FIG. 6. The screens 94 are thus constructed substantially like the screens 82 and are insertable in and removable from the enclosure 38 in the same manner that the screens 82 are insertable in and removable from the enclosures 26 and 28**.

The beaters 92 are rotatably driven by drive means, also comprising a drive motor 170, FIG. 3, drivably connected to an endless belt 172 which is trained around a pulley 174 supported on shaft **92*a* of the first beater stage of the cleaning stage 36. A second drive pulley 176 is also mounted on shaft 92*a* of the first beater stage and is drivably connected to the second beater stage shaft 92*a* by way of a belt 178 trained around a second pulley 176. The second through the seventh beater stages of the cleaning stage 36 are also provided with dual drive pulleys 176 and 177 arranged in the same manner as the pulleys 124 and 126 for the beaters of cleaning stage 24, as shown in FIGS. 3 and 4. However, successive beaters 92 arranged seriatim downstream from each other in the cleaning stage 36 may have drive pulleys mounted on the respective shafts 92*a* of slightly different diameter in order to provide progressively increasing linear tip speeds of the pins 92*d* of these successive beater stages to facilitate a lint beating and cleaning process in accordance with the invention. Higher beater pin tip speeds are desirable to adequately beat or clean the shorter lint fibers processed by the cleaning stage 36. The fourth beater stage of the cleaning stage 36, as shown in FIG. 6, for example, includes an outboard drive pulley 176 and an inboard drive pulley 177, the inboard drive pulley 177 being of a slightly smaller effective diameter than the pulley 176. By suitable arrangement of the drive pulleys 176 and 177 on the shafts 92*a* the rotational speeds of the respective beaters 92 may be varied as desired and thus the tip speeds of the pins 92*d*** of each beater stage will be varied in accordance with the rotational speeds of the rotor shafts on which these pins are mounted.

Referring again to FIGS. 2, 6 and 7, the cleaning apparatus 20 advantageously includes a pressure air jet or air blast systems for cleaning the respective screens 82 of cleaning stage 24. As shown in FIGS. 2 and 6, each of the beaters 80 forming a beater stage is provided with two spaced apart elongated air jet manifolds 182 disposed below the screens 82 and spaced apart from each other between the respective elongated support members 136 for each screen 82. The manifolds 182 are characterized as elongated cylindrical tubes extending between the frame members **22*d* and supported thereby for limited rotation by mechanism described hereinbelow. Each manifold 182 includes a plurality of spaced apart air jet nozzles or ports 184 formed therein and generally axially aligned with each other. Each manifold 182 is closed at one end by a suitable closure member 188 which is also operable to retain the manifold on the frame 22 for the limited rotation mentioned above. The opposite end of each manifold 182 is also journaled by a suitable bushing 189, FIG. 6, mounted on the manifold adjacent a frame member 22*d*. Each manifold 182 projects through suitable bearing bores in the frame members 22*d* and is supported by the frame members for limited rotation thereon so that the ports 184 may be moved between working positions directed generally upwardly toward the screens 82 and non-working positions projecting generally downwardly to prevent material passing through the screens 82 from falling into and clogging the respective ports. Two spaced apart manifolds 182 are disposed below each of the screens 82, as indicated in FIG. 2**.

Figure 8:
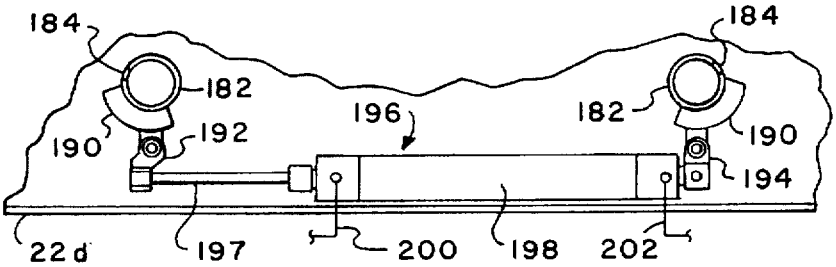
FIGS. 8 and 9 are detail views showing alternate positions of one of the actuators for the air jet cleaning manifolds.
Figure 9:
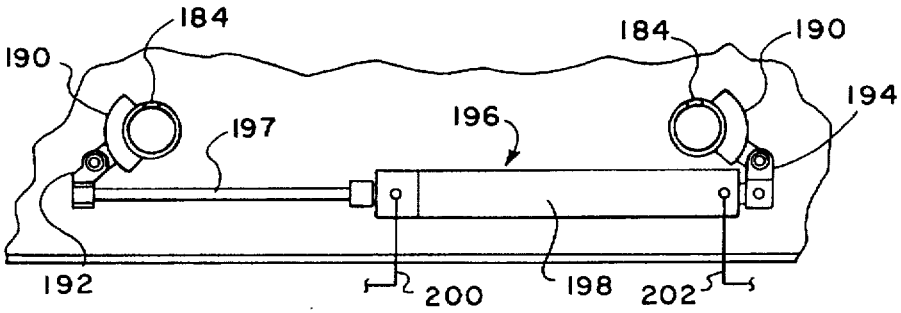
Figure 11:
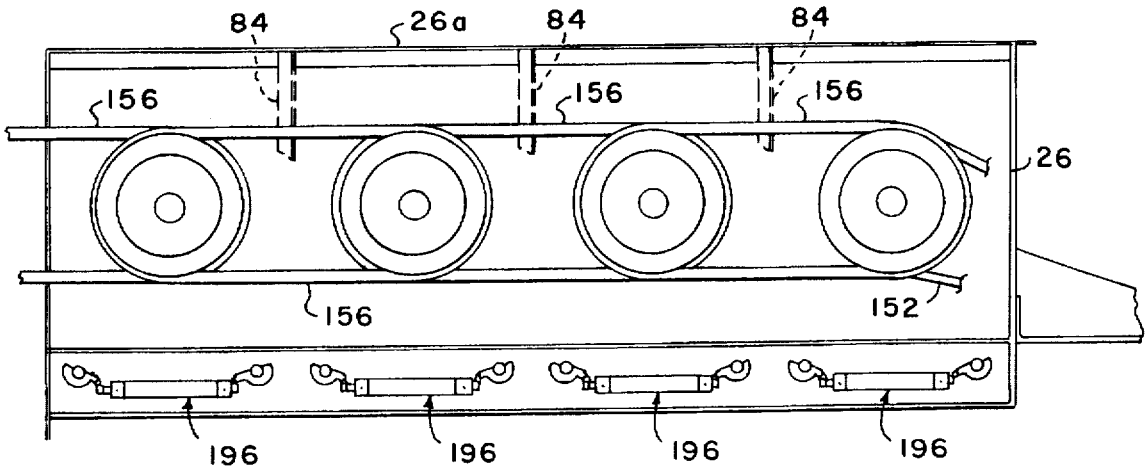
FIG. 11 is a side elevation of one of the rotary beater cabinets showing the actuators for the air jet cleaning manifolds for each beater separator or filter screen.

Referring now primarily to FIGS. 7, 8 and 9, each of the manifolds 182 is provided, at one end thereof, with a crank member 190 secured to the manifold and pivotally connected to a link 192 or 194, which links are connected to respective opposite ends of a linear actuator 196 comprising a pressure fluid actuated cylinder and piston type actuator, for example. Link 192 is suitably connected to the distal end of a linearly extensible piston rod 197 and link 194 is suitably connected to the opposite end of a cylinder member 198 of actuator 196. The actuator 196 may be a double acting type having suitable ports to which are connected flexible pressure fluid conduits 200 and 202, respectively. Alternatively, the actuator 196 may be pressure fluid, actuated in one direction and operated by a spring mechanism to return to a predetermined position when deenergized. Each pair of manifolds 182 associated with a beater 80 and screen 82 is connected to an actuator 196, as shown, for example, for the beaters in enclosure 26, FIG. 11.

In the position of the actuator 196 shown in FIG. 7, the manifolds 182 are rotated to position their nozzles or ports 184 generally downwardly so that particulate material and fine or short lint fibers passing through the screen 82 will not clog the ports as such material falls from the enclosures 26 or 28 onto the conveyor belt 86 by way of the duct 42. However, when it is desired to clean and unclog the slots 130 of screens 82, for example, the actuator 196 is moved from the position shown in FIG. 7 to the position shown in FIG. 8 wherein the ports 184 of each manifold 182 are oriented to eject pressure fluid, such as compressed air, toward the screen 82 to dislodge any material which may be clogging the slots 130. As the actuators 196 for each of the screens 82 are extended further to a working position as indicated in FIG. 9, the manifolds 182 are rotated so that the ports 184 sweep across the underside of the screens 82 to dislodge any material which may be clogging any of the slots 130. The range of coverage of the air jet action which is provided by the manifolds 182 is indicated by lines 184*a*, 184*b* in FIG. 7, for each of the manifolds. Accordingly, as the manifolds 182 are rotated to the position of FIG. 8 pressure air may be supplied to the manifolds to begin the air jet cleaning action and as the manifolds are further rotated to the position of FIG. 9 the ports 184 are rotated between the lines 184*a* and 184*b* to sweep an air jet curtain across the screens 82 between the respective sets of lines 184*a* and 184*b* to substantially cover the entire working area of the screens 82 and to dislodge any material which has clogged any of the slots 130. When the cleaning action has been completed, the actuator 196 for each of the screens 82 is returned to the position shown in FIG. 7.

Figure 10:
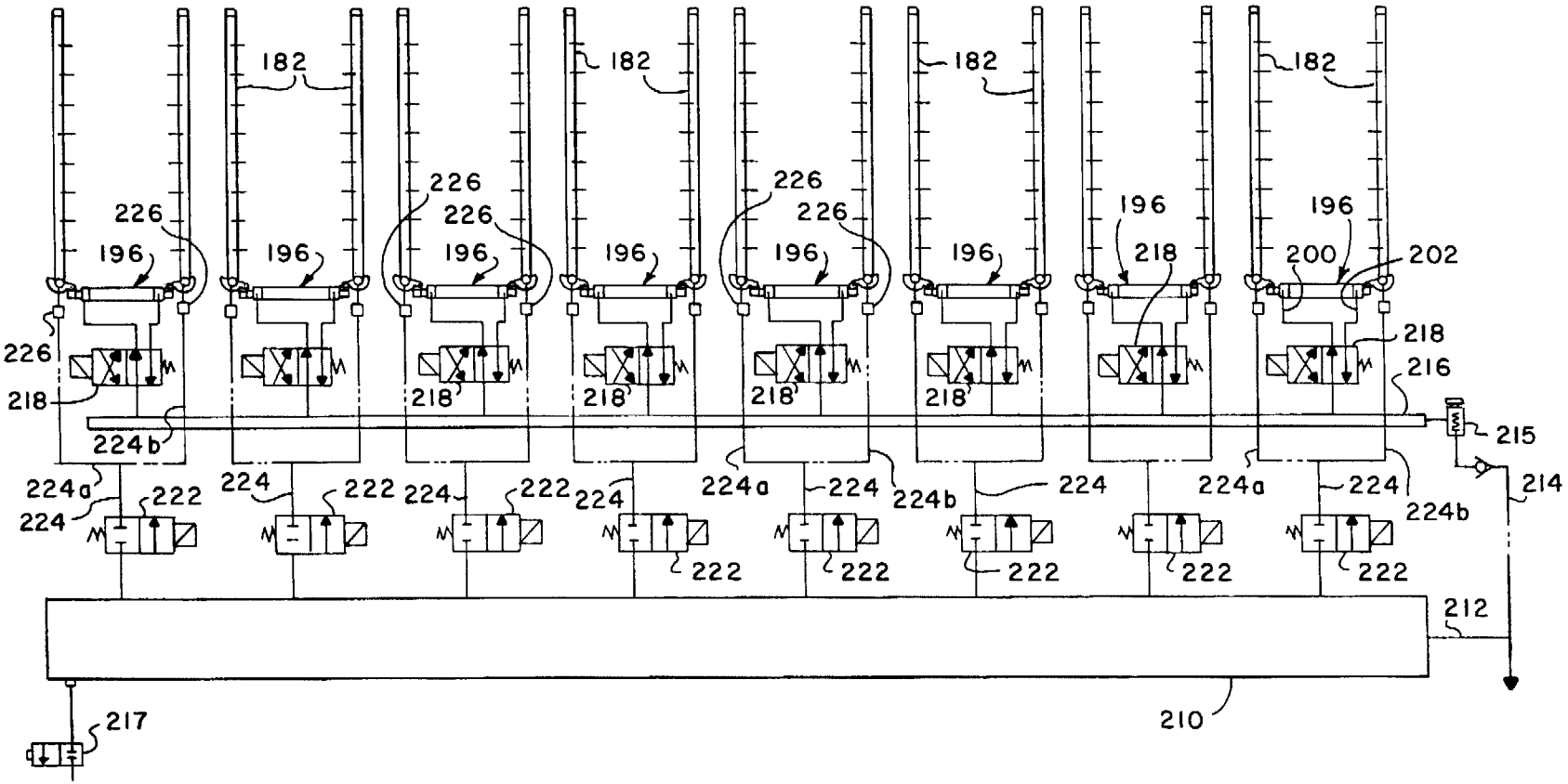
FIG. 10 is a schematic diagram of the air jet cleaning manifold system.

Referring now to the schematic diagram of FIG. 10, each of the manifolds 182 is operable to be supplied with pressure air from a reservoir or accumulator tank 210 which is preferably adapted to be mounted on and adjacent to one of the frame members 22*d* on spaced apart brackets 211, as shown in FIGS. 3 and 6. The reservoir 210 is adapted to be supplied with pressure air from a source, not shown, by way of a conduit 212, FIG. 10, connected to one end of the reservoir. A branch conduit 214 is also connected to the above-mentioned source of pressure air and to an elongated supply conduit 216 for respective control valves 218 for each of the actuators 196, as indicated schematically in FIG. 10. Each of the valves 218 may be a solenoid actuated reversible valve operable to move an actuator 196 connected thereto between the position shown in FIG. 7 and the positions shown in FIGS. 8 and 9. A pressure regulator 215 is interposed in conduit 214 and a suitable solenoid actuated blowdown valve 217 is also connected to reservoir 210.

Each set of manifolds 182 is supplied with pressure air from the reservoir 210 by way of a solenoid actuated valve 222, which is connected to a discharge conduit 224 having respective branch portions 224*a* and 224*b*. Each of the conduits 224*a* and 224*b* may be connected to a suitable swivel type coupling 226 suitably connected to each of the manifolds 182 so that the manifolds may rotate relative to the conduits 224*a* and 224*b*, respectively. A suitable control circuit, not shown, may be provided for energizing each of the valves 218 and 222 at selected time intervals and in timed relationship with respect to each other to rotate the manifolds 182 and supply pressure air thereto, respectively. For example, each successive beater stage having a beater 80 disposed therein may have its screen 82 cleaned sequentially if the apparatus 20 is momentarily shut down or lint inflow is terminated, for example. Those skilled in the art will appreciate that the beater stages of cleaning stage 36 may also be provided with an array of air jet cleaning manifolds, such as the manifolds 182, arranged in a substantially similar manner and supported below each screen 94 for providing air jet blast cleaning of the slots or openings in the screens 94 to unclog same, when desired.

The construction and operation of the cleaning apparatus 20 is believed to be within the purview of one of ordinary skill in the art from the foregoing description. However, briefly, the proportions of the beaters 80 and 92 have been determined to be such that, in a preferred embodiment, the diameter of the cylindrical cover 80*c* of each of the beaters 80 may be approximately 14.0 inches and the length of each beater 80 may be approximately 48.0 inches. The radial height of each of the pins 80*d* may be approximately 2.0 inches. The pins 80*d* are spaced along the length of the cylindrical cover 80*c* such that about twenty pins per row are provided and twelve rows of pins are circumferentially spaced about the axis of rotation of each shaft 80*a*. The beaters 80 are preferably rotated at a speed of about 200 rpm to 240 rpm. It has been determined that a tip speed of the pins 80*d* in the range of about 1130 feet per minute (plus or minus 5%) is an optimal speed to prevent damaging cotton lint fibers while also removing a substantial amount of particulate material trapped in the lint. The proportions of the slots 130 for the screens 82 may be somewhat elongated or oval shaped and range from 0.31 inches width by 1.0 inches length to 0.12 inches width by 0.63 inches length, depending on the characteristics of the lint being processed. Lint (and particulate material) which drops through the screens 82 onto the conveyor beltrun 86*a* is not compacted due to the large generally planar area of the belt which is presented to the material as it falls through the duct 42 onto the belt generally planar surface. The proportions of the conveyor 40 are such that the width of the belt 86 is at least about seventy five percent of the length of the beaters 80 so that minimal compacting or piling of the lint material occurs as some lint slides along sloped sidewalls of duct 42 during transfer from the cleaning stage 24 to the conveyor 40.

Since the lint fibers which are introduced to the cleaning stage 36 are shorter, as a result of being separated from the longer fibers in cleaning stage 24, the configuration of the beaters 92 is somewhat different. For example, the overall radial height or length of the pins 92*d* is in the range of about 2.0 inches to 3.50 inches, and the overall diameter of the beater 92 is about 8.0 inches to 11.0 inches. Preferably, six rows of beater pins 92*d* are spaced apart circumferentially about the shaft hub 92*b* and the pins are spaced apart about 1.125 inches, giving an overall number of forty-two pins per row. The first stage beater 92 is rotated at a speed of about 200 rpm and each successive stage is rotated at a speed about 5% higher than the previous stage by an appropriate proportioning of the drive pulleys 176 and 177 for each shaft 92*a*. The slots formed in screens 94 may be elongated or oval and range from dimensions of about 0.12 inches width by 1.0 inch length to about 0.38 inches width to 0.62 inches length, again depending on the characteristics of the lint being cleaned.

The vibrating screen separator or cleaning stage 54 may be arranged such that the pan 100 is oriented at a slope of about 7.50 degrees off of the horizon toward the receptacle 34. The crankshaft 116 and crank linkage 114 and 110 may be proportioned such as to give a linear travel of about 0.75 inches for the pan 100. Screen 99 may have perforations of about 0.125 inches in diameter to about 0.187 inches in diameter, depending on the material being processed.

The construction and operation of the apparatus 20, as mentioned previously, is believed to be within the purview of the skilled artisan in lint cleaning apparatus based on the foregoing description. Conventional materials used for lint cleaning apparatus may be used in apparatus 20. However, those skilled in the art will further appreciate that various substitutions and modifications may be made to the embodiment disclosed herein without departing from the scope and spirit of the invention as recited in the appended claims.

What is claimed is:

1. Apparatus for cleaning lint to remove particulate material therefrom, comprising:

a first cleaning stage comprising a first enclosure means including an inlet port for receiving particulate material laden lint, separating screen means and a discharge duct for discharging cleaned lint;

means for conducting particulate material including lint fibers separated from said lint in said first cleaning stage from said first cleaning stage;

conveyor means disposed in flow receiving communication with said means for conducting said particulate material including said lint fibers to a second cleaning stage without compacting said lint fibers; and a second cleaning stage for separating additional particulate material from lint passing through said screen means of said first cleaning stage, said second cleaning stage including second enclosure means, an inlet port in said second enclosure means in communication with said conveyor means and a discharge duct for discharging cleaned lint from said second cleaning stage, said second cleaning stage including separating screen means for passing particulate material and fine lint therethrough from said second cleaning stage.

2. The apparatus set forth in claim 1 wherein:

said first cleaning stage comprises a plurality of rotary beaters arranged seriatim in said first enclosure means and each of said beaters including separating screen means adjacent thereto for allowing particulate material to pass therethrough.

3. The apparatus set forth in claim 1 including:

a third cleaning stage arranged to receive material separated in said second cleaning stage and passing through said screen means of said second cleaning stage, said third cleaning stage including a vibrating screen for separating fine lint from particulate material in said third cleaning stage and means for conducting said fine lint from said third cleaning stage.

4. The apparatus set forth in claim 3 wherein:

said vibrating screen is mounted on a pan disposed below said second cleaning stage, said pan including a bottom plate for receiving material separated from lint by said vibrating screen and for conducting said material to a receptacle disposed at one end of said pan.

5. The apparatus set forth in claim 4 wherein:

said vibrating screen is connected to drive means for effecting reciprocating movement of said vibrating screen.

6. The apparatus set forth in claim 1 wherein:

said second cleaning stage comprises a plurality of rotary beaters arranged seriatim for cleaning said lint fibers and screen means associated with said rotary beaters of said second cleaning stage for separating particulate material from lint passing through said rotary beaters of said second cleaning stage, respectively.

7. The apparatus set forth in claim 1 wherein:

said apparatus includes means forming an air gap at said discharge duct of said first cleaning stage and an aspirating nozzle for inducting lint thereinto from said first cleaning stage and for effecting further separation of particulate material from said lint in said air gap.

8. The apparatus set forth in claim 1 including:

a conduit positioned adjacent to said discharge duct of said second cleaning stage and forming an air gap therebetween, and a first aspirating nozzle connected to said conduit for inducting lint discharged from said second cleaning stage and for effecting separation of particulate material therefrom in said air gap.

9. The apparatus set forth in claim 8 including:

a duct in communication with said third cleaning stage and connected to a second aspirating nozzle for inducting lint cleaned in said third cleaning stage into said aspirating nozzle.

10. The apparatus set forth in claim 9 including:

conduit means for conducting lint inducted by said aspirating nozzles to said first cleaning stage.

11. The apparatus set forth in claim 1 wherein:

said conveyor means comprises endless belt means disposed below said screen means of said first cleaning stage for receiving material passing therethrough, said belt means being operable to transport said material to one end of said conveyor means for discharge to said second cleaning stage.

12. The apparatus set forth in claim 1 including:

a frame including means for supporting said conveyor means above said second cleaning stage, a duct interconnecting said first cleaning stage with an enclosure for said conveyor means and a duct interconnecting said enclosure for said conveyor means with said second enclosure means; and a duct disposed below said second enclosure means for conducting material separated in said second cleaning stage for receipt by said third cleaning stage.

13. The apparatus set forth in claim 1 wherein:

said enclosure means of at least one of said cleaning stages comprises plural screen members including support means therefor, respectively, for supporting said screen members in a working position within said enclosure means and for inserting and removing said screen members with respect to said enclosure means, at will.

14. The apparatus set forth in claim 1 wherein:

said second cleaning stage comprises a plurality of rotary beaters disposed within said second enclosure means, respective separating screens associated with each of said rotary beaters of said second cleaning stage for separating particulate material and fine lint from lint passing through said second cleaning stage, each of said screens of said second cleaning stage being mounted on support means for removal from said enclosure of said second cleaning stage, at will.

15. The apparatus set forth in claim 1 including:

pressure air manifold means disposed in proximity to said screen means of said first cleaning stage for ejecting pressure air toward said screen means of said first cleaning stage to remove material clogging said screen means of said first cleaning stage.

16. The apparatus set forth in claim 15 wherein:

said manifolds means comprise elongated tubular manifolds disposed for movement between working positions and nonworking positions, respectively, and said apparatus includes actuator means connected to said manifolds for moving said manifolds between said positions.

17. The apparatus set forth in claim 16 including:

a pressure air reservoir operably connected to said manifolds for discharging pressure air to said manifolds, respectively, and control valve means interposed between said reservoir and said manifolds for controlling the flow of pressure air to said manifolds, respectively.

18. The apparatus set forth in claim 16 wherein:

said actuator means comprise pressure air cylinder and piston means operably connected to a source of pressure air by way of control valve means for operating said actuator means to move said manifolds between said positions.

19. Apparatus for cleaning lint to remove particulate material therefrom, comprising:

a first lint cleaning stage comprising an enclosure having opposed sidewalls;

means disposed within said enclosure for agitating lint laden with particulate material for effecting separation of particulate material and relatively short lint fibers from longer fibers of said lint;

a separator screen disposed in proximity to said means for agitating for causing particulate material and short lint fibers to pass through said screen to be separated from said longer fibers; and support means for supporting said screen within said enclosure in proximity to said means for agitating and for inserting said screen into and removing said screen from said enclosure, at will.

20. The apparatus set forth in claim 19 wherein:

said means for supporting said screen comprises opposed endplates connected to said screen, one of said endplates including means forming a drawer face;

one of said sidewalls of said enclosure includes an opening for receiving said screen including said support means for said screen whereby said screen and said support means for said screen may be inserted in and removed from said enclosure, said drawer face being operable to close said opening in said sidewall in a working position of said screen within said enclosure.

21. The apparatus set forth in claim 19 wherein:

said means for agitating comprises a plurality of rotary drum lint beaters mounted in said enclosure side by side for transferring said lint seriatim from one beater to the next upon rotation of said beaters, respectively; and said apparatus includes a separating screen disposed adjacent each of said beaters for separating particulate material and short lint fibers from longer fibers, each of said screens including support means operable for inserting each of said screens, individually, into and removing each of said screens, individually, from said enclosure, at will.

22. The apparatus set forth in claim 21 wherein:

one of said sidewalls of said enclosure includes a plurality of openings for receiving said screens therein, respectively and said enclosure includes support means for supporting said screen support means in a working position, generally beneath each of said beaters, respectively.

23. The apparatus set forth in claim 22 including:

a second lint cleaning stage including a second enclosure having opposed sidewalls, means in said second enclosure for agitating lint received from said first enclosure; and a screen operable for separating particulate material from lint passing through said second enclosure, said screen including support means for supporting said screen in said second enclosure and being operable for inserting said screen in and removing said screen from said second enclosure, at will.

24. The apparatus set forth in claim 23 wherein:

said means for agitating in said second cleaning stage comprises a plurality of rotary drum lint beaters mounted in said second enclosure side by side for transferring said lint seriatim from one beater to the next upon rotation of said beaters, respectively; and said apparatus includes a separating screen disposed adjacent each of said beaters of said second cleaning stage for separating particulate material and short lint fibers from longer fibers, each of said screens in said second cleaning stage including support means adapted to be operable for inserting each of said screens in said second cleaning stage, individually, into and removing each of said screens in said second cleaning stage, individually, from said enclosure, at will.

25. The apparatus set forth in claim 24 wherein:

one of said sidewalls of said second enclosure includes a plurality of openings for receiving screens therein, respectively, and said second enclosure includes support means for supporting screen support means in a working position, generally beneath each of said beaters of said second cleaning stage, respectively.

26. The apparatus set forth in claim 19 including:

pressure air manifold means disposed in proximity to said screen for ejecting pressure air toward said screen to remove material clogging said screen.

27. The apparatus set forth in claim 26 wherein:

said manifold means comprises a plurality of spaced apart air ejection ports disposed thereon, and said manifold means is mounted on said apparatus for movement between a first position wherein said ports are disposed to prevent particulate material from clogging said ports, respectively, and a second position for ejecting pressure air toward said screen to remove material clogging said screen.

28. The apparatus set forth in claim 27 including:

actuator means connected to said manifold means for moving said manifold means between said positions.

29. Apparatus for cleaning lint, comprising:

an enclosure;

means disposed in said enclosure for agitating lint in said enclosure to separate particulate material and short lint fibers from longer fibers of said lint;

a screen disposed in proximity to said means for agitating operable to pass particulate material and short lint fibers through said screen to separate said particulate material and said short lint fibers from longer fibers; and pressure air manifold means disposed adjacent to said screen including air ejection port means formed therein and operable to eject pressure air toward said screen for removing material clogging said screen.

30. The apparatus set forth in claim 29 wherein:

said manifold means comprises at least one elongated tubular manifold and a plurality of air ejection ports spaced along said manifold, said manifold being mounted on said apparatus for movement between a first position wherein said ports are oriented to prevent being clogged by material passing through said screen and a second position for ejecting pressure air toward said screen; and means for moving said manifold between said first and second positions.

31. The apparatus set forth in claim 30 including:

actuator means connected to said manifold comprising a pressure air cylinder and piston actuator operably connected to a source of pressure air by way of control valve means for operating said actuator means to move said manifold between said first and second positions.

32. The apparatus set forth in claim 31 wherein:

said manifold means comprise two spaced apart tubular manifolds mounted on said apparatus for movement between said first and second positions, respectively; and said actuator means is operably connected to both of said manifolds and is operable to move both of said manifolds between said first and second positions, respectively.

33. The apparatus set forth in claim 32 wherein:

said actuator means comprises a pressure air cylinder and piston, a link connected to a piston rod connected to said piston at a distal end of said piston rod and a link connected to one end of said cylinder, said links being operably connected to respective ones of said manifolds for causing said manifolds to rotate in response to actuation of said actuator to extend and retract said piston rod with respect to said cylinder.

34. The apparatus as set forth in claim 32 including:

a pressure air reservoir operably connected to each of said manifolds for discharging pressure air to said manifolds, respectively, and control valve means interposed between said reservoir and said manifolds for controlling the flow of pressure air to said manifolds, respectively.

* * * * *

US005762171C1

(12) EX PARTE REEXAMINATION CERTIFICATE (6062nd)

United States Patent

Mizer

(10) Number: US 5,762,171 C1

(45) Certificate Issued: Dec. 25, 2007

(54) LINT CLEANING APPARATUS

(75) Inventor: Michael A. Mizer, Savannah, GA (US)

(73) Assignee: Carver, Inc., Savannah, GA (US)

Reexamination Request:
No. 90/007,740, Sep. 30, 2005

Reexamination Certificate for:

| | |
|---|---|
| Patent No.: | **5,762,171** |
| Issued: | **Jun. 9, 1998** |
| Appl. No.: | **08/713,161** |
| Filed: | **Sep. 12, 1996** |

(51) Int. Cl.

| | |
|---|---|
| ***D01B 1/00*** | (2006.01) |
| ***D01B 1/04*** | (2006.01) |

(52) U.S. Cl. ..... 19/41

(58) Field of Classification Search ..... 19/39, 19/40, 41, 42, 44, 48 R, 64.5, 46, 47; 426/484; 99/603, 604

See application file for complete search history.

(56) References Cited

U.S. PATENT DOCUMENTS

| | | | | |
|---|---|---|---|---|
| 1,538,244 A | | 5/1925 | Hopkins | |
| 1,680,978 A | | 8/1928 | Garner | |
| 4,173,177 A | | 11/1979 | Davis | 99/618 |
| 5,392,495 A | * | 2/1995 | Horn | 19/55 R |
| 5,412,844 A | * | 5/1995 | Horn et al. | 19/40 |

OTHER PUBLICATIONS

Carver, Inc., 48" and 70" 8–Basket In–Line Hull Beater operation and maintenance document, Nov. 1994.

The Delining of Cotton Seed, M.C., Verdery, Jun. 1979.

* cited by examiner

*Primary Examiner*—Sara Clarke

(57) ABSTRACT

A multistage lint cleaning apparatus includes plural series arranged rotary drum beaters in a first cleaning stage, each beater having a separating screen disposed adjacent thereto for separating particulate material and fine lint from longer fiber lint. Each screen is configured as drawer supported within an enclosure for insertion and removal, at will. Clean lint discharged from the first cleaning stage passes through an air gap and into a duct connected to an aspirating nozzle for further separation of particulate material. A linear belt conveyor receives particulate material and fine lint from the first cleaning stage for discharge to a second cleaning stage also comprising a series of rotary drum beaters. Separating screens associated with each beater of the second cleaning stage are also configured to be inserted in and removed from an enclosure, at will. A third cleaning stage comprises a vibrating screen. Lint discharged from the second and third stages is inducted by an pneumatic conveying system, including an aspirating or induction nozzle. Spaced apart tubular air jet manifolds are disposed below the screens of at least the first cleaning stage and are supported on the apparatus frame for movement between working and non-working positions of respective rows of jet nozzle ports in the manifolds by pneumatic actuators whereby the manifolds may be moved to a position to prevent clogging of the nozzle ports by particulate material falling through the screens.

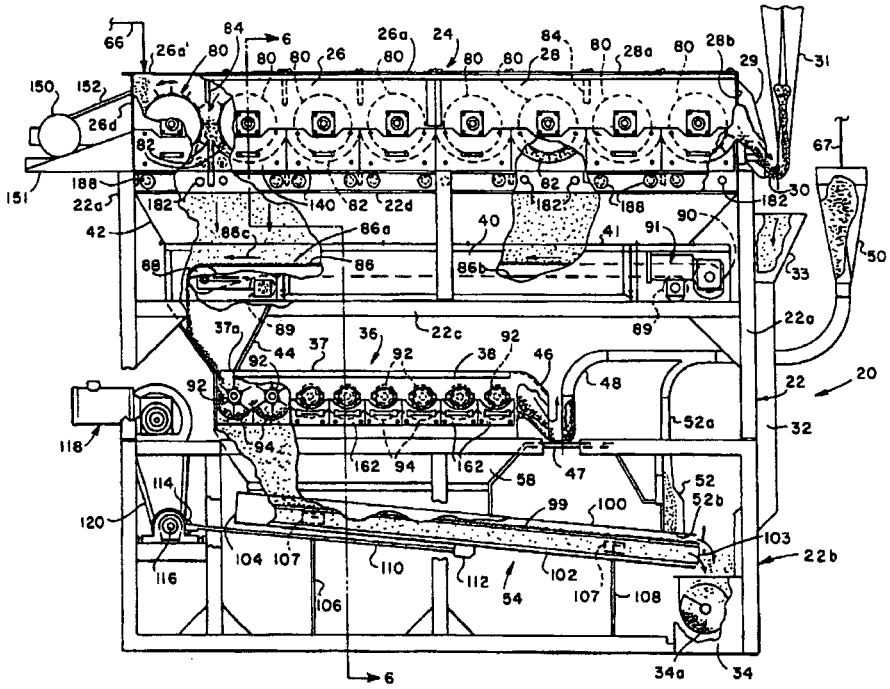

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 29–34 is confirmed.

Claims 1 and 19–21 are cancelled.

Claims 2, 3, 6–8, 11–15, 22 and 26 are determined to be patentable as amended.

Claims 4, 5, 9, 10, 16–18, 23–25, 27 and 28, dependent on an amended claim, are determined to be patentable.

2. [The apparatus set forth in claim 1] *Apparatus for cleaning lint to remove particulate material therefrom, comprising:*

*a first cleaning stage comprising a first enclosure means including an inlet port for receiving particulate material laden lint, separating screen means and a discharge duct for discharging cleaned lint;*

*means for conducting particulate material including lint fibers separated from said lint in said first cleaning stage from said first cleaning stage;*

*conveyor means disposed in flow receiving communication with said means for conducting said particulate material including said lint fibers to a second cleaning stage without compacting said lint fibers; and*

*a second cleaning stage for separating additional particulate material from lint passing through said screen means of said first cleaning stage, said second cleaning stage including second enclosure means, an inlet port in said second enclosure means in communication with said conveyor means and a discharge duct for discharging cleaned lint from said second cleaning stage, said second cleaning stage including separating screen means for passing particulate material and fine lint therethrough from said second cleaning stage* wherein:

said first cleaning stage comprises a plurality of rotary beaters arranged seriatim in said first enclosure means and each of said beaters including separating screen means adjacent thereto for allowing particulate material to pass therethrough.

3. [The apparatus set forth in claim 1] *Apparatus for cleaning lint to remove particulate material therefrom, comprising:*

*a first cleaning stage comprising a first enclosure means including an inlet port for receiving particulate material laden lint, separating screen means and a discharge duct for discharging cleaned lint;*

*means for conducting particulate material including lint fibers separated from said lint in said first cleaning stage from said first cleaning stage;*

*conveyor means disposed in flow receiving communication with said means for conducting said particulate material including said lint fibers to a second cleaning stage without compacting said lint fibers; and*

*a second cleaning stage for separating additional particulate material from lint passing through said screen means of said first cleaning stage, said second cleaning stage including second enclosure means, an inlet port in said second enclosure means in communication with said conveyor means and a discharge duct for discharging cleaned lint from said second cleaning stage, said second cleaning stage including separating screen means for passing particulate material and fine lint therethrough from said second cleaning stage;*

*said apparatus* including:

a third cleaning stage arranged to receive material separated in said second cleaning stage and passing through said screen means of said second cleaning stage, said third cleaning stage including a vibrating screen for separating fine lint from particulate material in said third cleaning stage and means for conducting said fine lint from said third cleaning stage.

6. [The apparatus set forth in claim 1] *Apparatus for cleaning lint to remove particulate material therefrom, comprising:*

*a first cleaning stage comprising a first enclosure means including an inlet port for receiving particulate material laden lint, separating screen means and a discharge duct for discharging cleaned lint;*

*means for conducting particulate material including lint fibers separated from said lint in said first cleaning stage from said first cleaning stage;*

*conveyor means disposed in flow receiving communication with said means for conducting said particulate material including said lint fibers to a second cleaning stage without compacting said lint fibers; and*

*a second cleaning stage for separating additional particulate material from lint passing through said screen means of said first cleaning stage, said second cleaning stage including second enclosure means, an inlet port in said second enclosure means in communication with said conveyor means and a discharge duct for discharging cleaned lint from said second cleaning stage, said second cleaning stage including separating screen means for passing particulate material and fine lint therethrough from said second cleaning stage* wherein:

said second cleaning stage comprises a plurality of rotary beaters arranged seriatim for cleaning said lint fibers and screen means associated with said rotary beaters of said second cleaning stage for separating particulate material from lint passing through said rotary beaters of said second cleaning stage, respectively.

7. [The apparatus set forth in claim 1] *Apparatus for cleaning lint to remove particulate material therefrom, comprising:*

*a first cleaning stage comprising a first enclosure means including an inlet port for receiving particulate material laden lint, separating screen means and a discharge duct for discharging cleaned lint;*

*means for conducting particulate material including lint fibers separated from said lint in said first cleaning stage from said first cleaning stage;*

*conveyor means disposed in flow receiving communication with said means for conducting said particulate material including said lint fibers to a second cleaning stage without compacting said lint fibers; and*

*a second cleaning stage for separating additional particulate material from lint passing through said screen*

*means of said first cleaning stage, said second cleaning stage including second enclosure means, an inlet port in said second enclosure means in communication with said conveyor means and a discharge duct for discharging cleaned lint from said second cleaning stage, said second cleaning stage including separating screen means for passing particulate material and fine lint therethrough from said second cleaning stage* wherein:

said apparatus includes means forming an air gap at said discharge duct of said first cleaning stage and an aspirating nozzle for inducting lint thereinto from said first cleaning stage and for affecting further separation of particulate material from said lint in said air gap.

8. [The apparatus set forth in claim 1] *Apparatus for cleaning lint to remove particulate material therefrom, comprising:*

*a first cleaning stage comprising a first enclosure means including an inlet port for receiving particulate material laden lint, separating screen means and a discharge duct for discharging cleaned lint;*

*means for conducting particulate material including lint fibers separated from said lint in said first cleaning stage from said first cleaning stage;*

*conveyor means disposed in flow receiving communication with said means for conducting said particulate material including said lint fibers to a second cleaning stage without compacting said lint fibers; and*

*a second cleaning stage for separating additional particulate material from lint passing through said screen means of said first cleaning stage, said second cleaning stage including second enclosure means, an inlet port in said second enclosure means in communication with said conveyor means and a discharge duct for discharging cleaned lint from said second cleaning stage, said second cleaning stage including separating screen means for passing particulate material and fine lint therethrough from said second cleaning stage;*

*said apparatus* including:

a conduit positioned adjacent to said discharge duct of said second cleaning stage and forming an air gap therebetween, and a first aspirating nozzle connected to said conduit for inducting lint discharged from said second cleaning stage and for affecting separation of particulate material therefrom in said air gap.

11. The apparatus set forth in claim [1] *2* wherein:

said conveyor means comprises endless belt means disposed below said screen means of said first cleaning stage for receiving material passing therethrough, said belt means being operable to transport said material to one end of said conveyor means for discharged to said second cleaning stage.

12. The apparatus set forth in claim [1] *2* including:

a frame including means for supporting said conveyor means above said second cleaning stage, a duct interconnecting said first cleaning stage with an enclosure for said conveyor means and a duct, interconnecting said enclosure for said conveyor means with said second enclosure means; and a duct disposed below said second enclosure means for conducting material separated in said second cleaning stage for receipt by said third cleaning stage.

13. [The apparatus set forth in claim 1] *Apparatus for cleaning lint to remove particulate material therefrom, comprising:*

*a first cleaning stage comprising a first enclosure means including an inlet port for receiving particulate material laden lint, separating screen means and a discharge duct for discharging cleaned lint;*

*means for conducting particulate material including lint fibers separated from said lint in said first cleaning stage from said first cleaning stage;*

*conveyor means disposed in flow receiving communication with said means for conducting said particulate material including said lint fibers to a second cleaning stage without compacting said lint fibers; and*

*a second cleaning stage for separating additional particulate material from lint passing through said screen means of said first cleaning stage, said second cleaning stage including second enclosure means, an inlet port in said second enclosure means in communication with said conveyor means and a discharge duct for discharging cleaned lint from said second cleaning stage, said second cleaning stage including separating screen means for passing particulate material and fine lint therethrough from said second cleaning stage* wherein:

said enclosure means of at least one of said cleaning stages comprises plural screen members including support means therefor, respectively, for supporting said screen members in a working position within said enclosure means and for inserting and removing said screen members with respect to said enclosure means, at will.

14. [The apparatus set forth in claim 1] *Apparatus for cleaning lint to remove particulate material therefrom, comprising:*

*a first cleaning stage comprising a first enclosure means including an inlet port for receiving particulate material laden lint, separating screen means and a discharge duct for discharging cleaned lint;*

*means for conducting particulate material including lint fibers separated from said lint in said first cleaning stage from said first cleaning stage;*

*conveyor means disposed in flow receiving communication with said means for conducting said particulate material including said lint fibers to a second cleaning stage without compacting said lint fibers; and*

*a second cleaning stage for separating additional particulate material from lint passing through said screen means of said first cleaning stage, said second cleaning stage including second enclosure means, an inlet port in said second enclosure means in communication with said conveyor means and a discharge duct for discharging cleaned lint from said second cleaning stage, said second cleaning stage including separating screen means for passing particulate material and fine lint therethrough from said second cleaning stage* wherein:

said second cleaning stage comprises a plurality of rotary beaters disposed within said second enclosure means, respective separating screens associated with each of said rotary beaters of said second cleaning stage for separating particulate material and fine lint from lint passing through said second cleaning stage, each of said screen of said second cleaning stage being mounted on support means for removal from said enclosure of said second cleaning stage, at will.

15. [The apparatus set forth in claim 1] *Apparatus for cleaning lint to remove particulate material therefrom, comprising:*

*a first cleaning stage comprising a first enclosure means including an inlet port for receiving particulate material laden lint, separating screen means and a discharge duct for discharging cleaned lint;*

*means for conducting particulate material including lint fibers separated from said lint in said first cleaning stage from said first cleaning stage;*

*conveyor means disposed in flow receiving communication with said means for conducting said particulate material including said lint fibers to a second cleaning stage without compacting said lint fibers; and*

*a second cleaning stage for separating additional particulate material from lint passing through said screen means of said first cleaning stage, said second cleaning stage including second enclosure means, an inlet port in said second enclosure means in communication with said conveyor means and a discharge duct for discharging cleaned lint from said second cleaning stage, said second cleaning stage including separating screen means for passing particulate material and fine lint therethrough from said second cleaning stage*

*said apparatus* including:

pressure air manifold means disposed in proximity to said screen means of said first cleaning stage for ejecting pressure air toward said screen means of said first cleaning stage to removed material clogging said screen means of said first cleaning stage.

22. [The apparatus set forth in claim 1] *Apparatus for cleaning lint to remove particulate material therefrom, comprising:*

*a first lint cleaning stage comprising a first enclosure having opposed sidewalls;*

*means disposed within said enclosure for agitating lint laden with particulate material for effecting separation of particulate material and relatively short lint fibers from longer fibers of said lint;*

*a separator screen disposed in proximity to said means for agitating for causing particulate material and short lint fibers to pass through said screen to be separated from said longer fibers; and*

*support means for supporting said screen within said enclosure in proximity to said means for agitating and for inserting said screen into and removing said screen from said enclosure, at will;*

*wherein said means for agitating comprises a plurality of rotary drum lint beaters mounted in said enclosure side by side for transferring said lint seriatim from one beater to the next upon rotation of said beaters, respectively; and*

*wherein said apparatus includes a separating screen disposed adjacent each of said beaters for separating particulate material and short lint fibers from longer fibers, each of said screens including support means operable for inserting each of said screens, individually, into and removing each of said screens, individually, from said enclosure, at will and* wherein:

one of said sidewalls of said enclosure includes a plurality of openings for receiving said screens therein, respectively and said enclosure includes support means for supporting said screen support means in a working position, generally beneath each of said beaters, respectively.

26. [The apparatus set forth in claim 19] *Apparatus for cleaning lint to remove particulate material therefrom, comprising:*

*a first lint cleaning stage comprising an enclosure having opposed sidewalls;*

*means disposed within said enclosure for agitating lint laden with particulate material for effecting separation of particulate material and relatively short lint fibers from longer fibers of said lint;*

*a separator screen disposed in proximity to said means for agitating for causing particulate material and short lint fibers to pass through said screen to be separated from said longer fibers; and*

*support means for supporting said screen within said enclosure in proximity to said means for agitating and for inserting said screen into and removing said screen from said enclosure, at will;*

*said apparatus* including:

pressure air manifold means disposed in proximity to said screen for ejecting pressure air toward said screen to remove material clogging said screen.

* * * * *